US005803269A

United States Patent [19]

Jacoby et al.

[11] Patent Number: 5,803,269

[45] Date of Patent: Sep. 8, 1998

[54] 300MM SHIPPING CONTAINER

[75] Inventors: Robert Jacoby, Plymouth; Barry Gregerson, Deephaven, both of Minn.

[73] Assignee: Empak, Inc., Chanhassen, Minn.

[21] Appl. No.: 913,225

[22] PCT Filed: Oct. 13, 1995

[86] PCT No.: PCT/US95/12514

§ 371 Date: Sep. 9, 1997

§ 102(e) Date: Sep. 9, 1997

[87] PCT Pub. No.: WO97/13708

PCT Pub. Date: Apr. 17, 1997

[51] Int. Cl.[6] ..... B65D 85/90

[52] U.S. Cl. ..... 206/592; 206/454; 206/591; 206/711

[58] Field of Search ..... 206/454, 591, 206/592, 710, 711

[56] References Cited

U.S. PATENT DOCUMENTS

| | | | |
|---|---|---|---|
| 3,338,390 | 8/1967 | Gordon | 206/591 |
| 3,719,271 | 3/1973 | Authier et al. | 206/711 |
| 3,889,815 | 6/1975 | Merle | 211/41 |
| 4,555,024 | 11/1985 | Voss et al. | 206/454 |
| 5,273,159 | 12/1993 | Gregerson | 206/334 |
| 5,423,422 | 6/1995 | Boire et al. | 206/334 |
| 5,575,394 | 11/1996 | Nyseth | 206/710 |

*Primary Examiner*—Jimmy G. Foster

*Attorney, Agent, or Firm*—Haugen & Nikolai, P.A.

[57] ABSTRACT

A container (10) for shipping items, such as silicon wafers, rigid memory disks, photo masks, liquid crystal displays and flat panel displays, is disclosed. The container has a bottom (20) and a removable top (30). Mounted to the inside of the container are three cushions (50, 51, 52). When the cover (30) is in place, the cushions are centered on support lines (60) which are 120° from each other. When so arranged, the cushions securely hold a plurality of items in a parallel, spaced-apart registration.

3 Claims, 9 Drawing Sheets

300MM SHIPPING CONTAINER

BACKGROUND OF THE INVENTION

I. Field of the Invention

The present invention relates to containers used to transport items from one location to another. More specifically, the present invention relates to containers particularly well suited for the transport of silicon wafers, rigid memory disks, photo masks, liquid crystal displays and flat panel displays.

II. Description of the Prior Art

Various containers have been used in the electronics industry to transport masks, displays, disks and wafers. The fragile nature of such items requires very reliable means for supporting such items within the container. Such items must be protected from vibration and shock. Such items must be held in such a way that they do not scrape, rub or impact the surfaces of the container or the other items stored therein. Such items must also be protected from particulation, static electricity and outgassing.

A recent trend has developed in the electronics industry, the result of which is the growth in size of masks, displays, wafers and disks. For example, while most wafers in use today have a diameter of 200 mm or less, new standards centered around 300 mm wafers are emerging. In the future, even layer wafers are likely to come into widespread use. As the size, weight and surface area of the wafers increase, new techniques must be found to protect them from damage. Rigid supports so prevalent in prior art containers to retain wafers are not sufficiently effective in protecting these larger wafers, particularly when the wafers are to be transported over great distances. Likewise, the flexible supporting schemes used in the prior art do not provide adequate support to minimize damage to the wafers. Conventional schemes provided two supports, one in the top and one in the bottom of the container which were positioned 180° from each other when the top was closed. Thus, there is a real need for shipping container capable of securely holding larger fragile items in a way to protect such items during transport.

SUMMARY OF THE INVENTION

The present invention provides a container having a bottom, a removable top, a pair of exterior ergonomic handles, an integral latch for locking the bottom to the top, and three internal cushions. Two of the cushions are secured to the bottom of the shipping container and one is secured to the top. When the top is closed, the center lines of support provided by the three cushions are equally spaced at 120°. This improved support geometry allows for a much greater load bearing area than conventional two cushion designs.

Conventional two cushion designs having the cushions positioned 180° form each other are more than adequate for lighter, smaller objects. However, they provide insufficient support for larger wafers or the like when the container is joined or shook from side to side. By providing three cushions and having them equally spaced around the edge of the items to be shipped, sufficient load bearing area is provided in all directions rather than just in the up and down directions. The use of three cushions in this manner also minimizes wafer rotation. This is desirable because particles generated as a result of wafer rotation can damage the wafers.

The advantages of the present invention will become more apparent from the reading of the detailed description of the preferred embodiment set forth below in conjunction with the drawings which form a part of the specification.

DESCRIPTION OF THE PREFERRED EMBODIMENT

Figure 1:
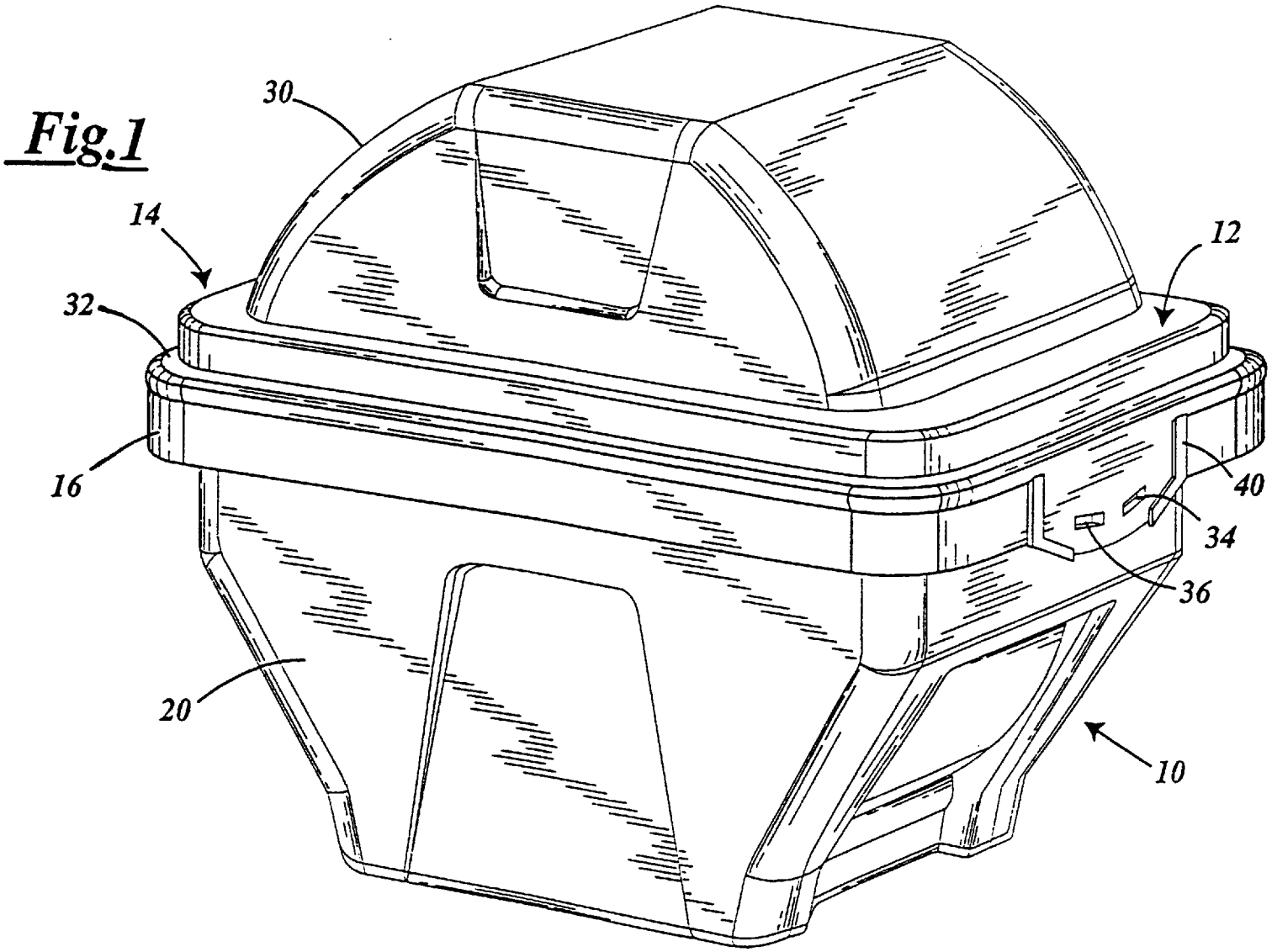
FIG. 1 is a perspective view of the shipping container's exterior.
Figure 2:
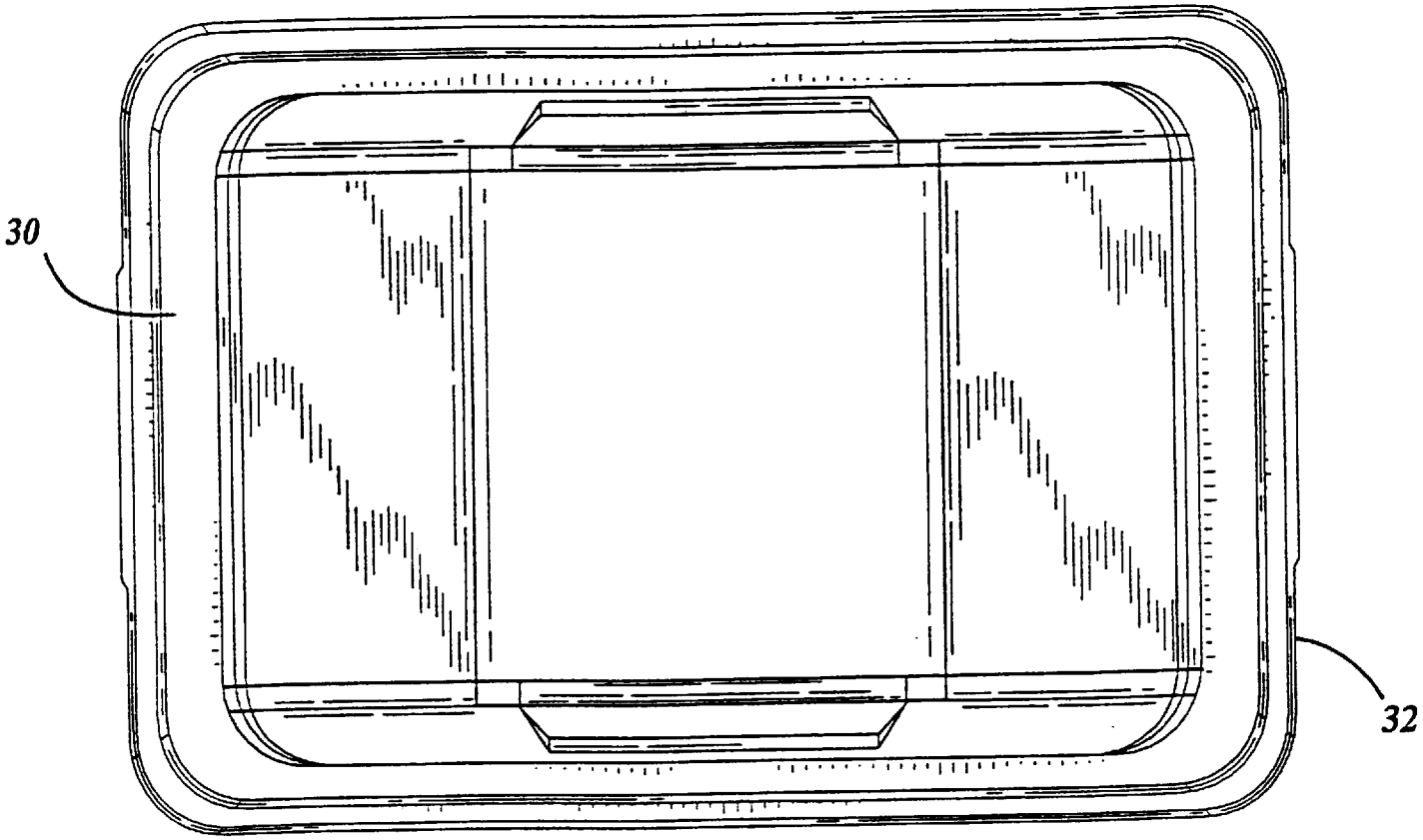
FIG. 2 is top plan view of the container's exterior.
Figure 3:
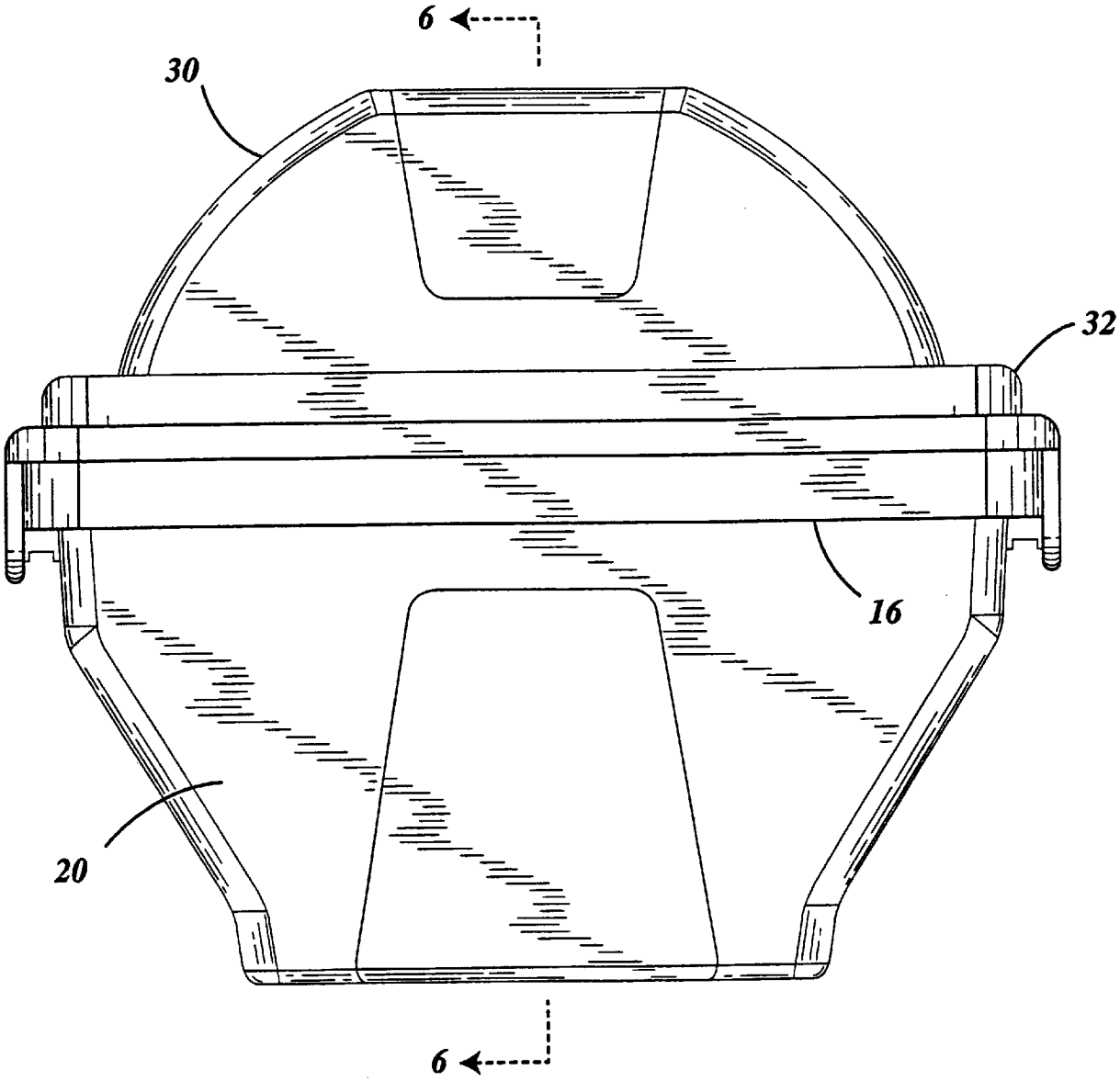
FIG. 3 is an elevational side view of the container's exterior.
Figure 4:
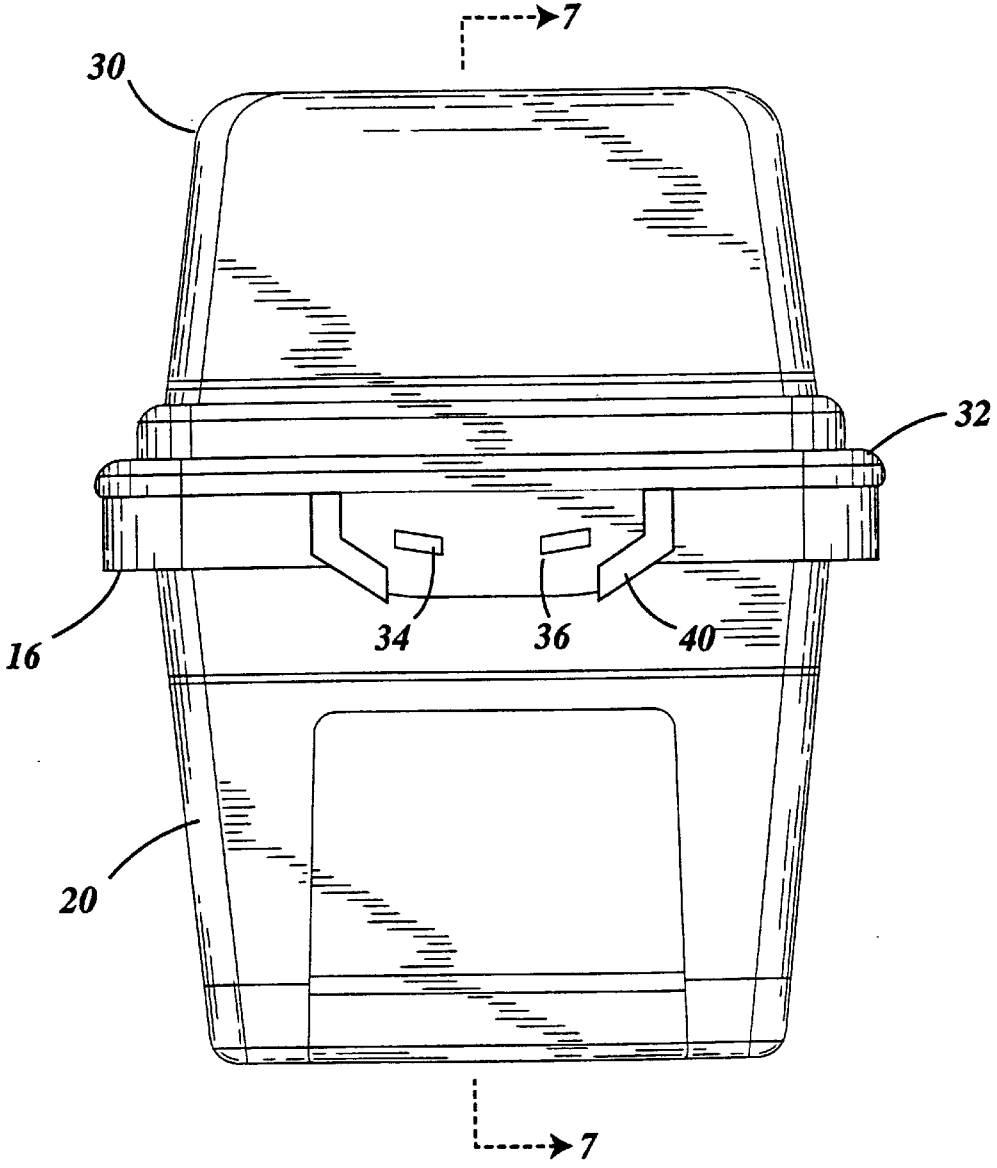
FIG. 4 is a elevational end view of the container's exterior.
Figure 5:
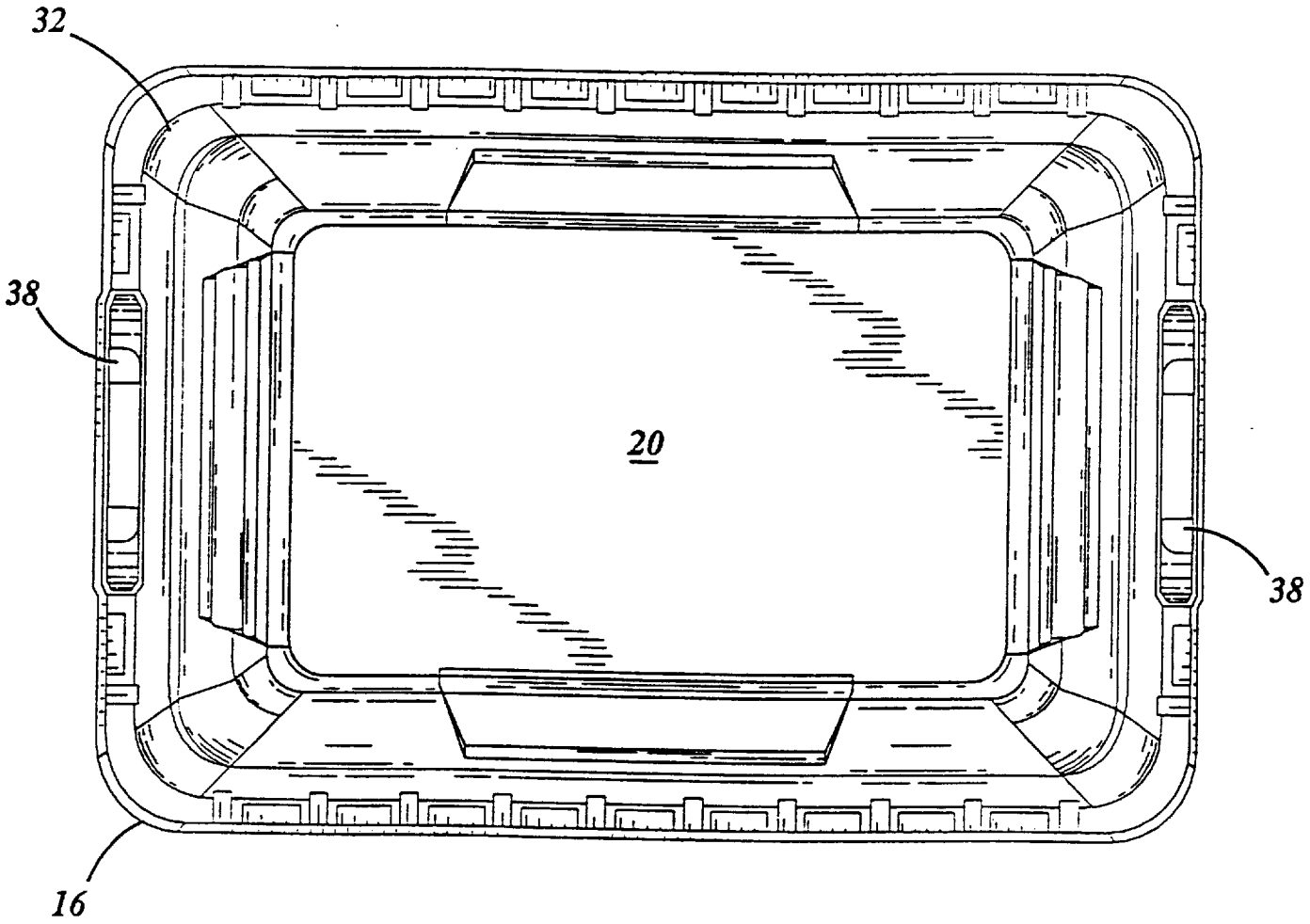
FIG. 5 is a bottom plan view of the container's exterior.
Figure 6:
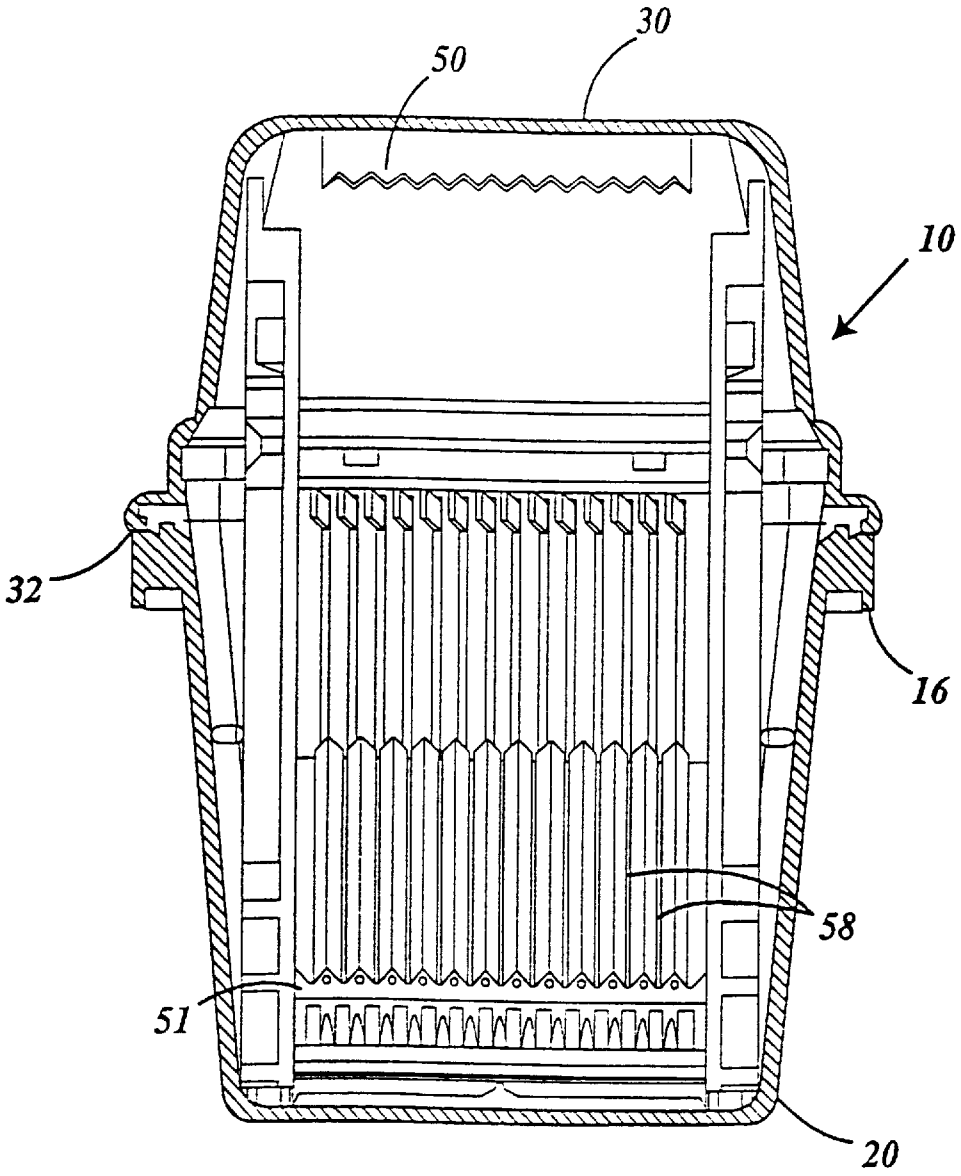
FIG. 6 is a cross section through line A—A in FIG. 3.

FIGS. 1–5 show the exterior of the container 10. The container 10 is specifically designed for transporting a plurality of items. Container 10 includes a bottom 20 having an opening for loading and unloading items and removable top 30 for covering the opening. The top 30 includes a skirt 32 which is designed to overlap the outer edges of the bottom 20 when the top 30 is in the closed position over the opening in the bottom. The container 10 also has a pair of handles 40 on the ends 12 and 14. One can grip and hold the container 10 at a variety of places.

Several techniques can be used to latch the bottom 20 to the top 30. For example, holes, such as 34 and 36, can be made in the skirt 32 of the top. Holes 34 and 36 are sized and positioned which mate with projections 38 on the bottom 20 when the top 30 is in the closed position. When this technique is used, there is a need for the skirt 32 to be gripped and flexed to move the holes 34 and 36 away from the projections 38 to unlatch the top 30 from the bottom 20. Other types of latches are well known in the art which could readily be used by those skilled in the art to latch the top 30 and bottom 20 together.

Figure 7:
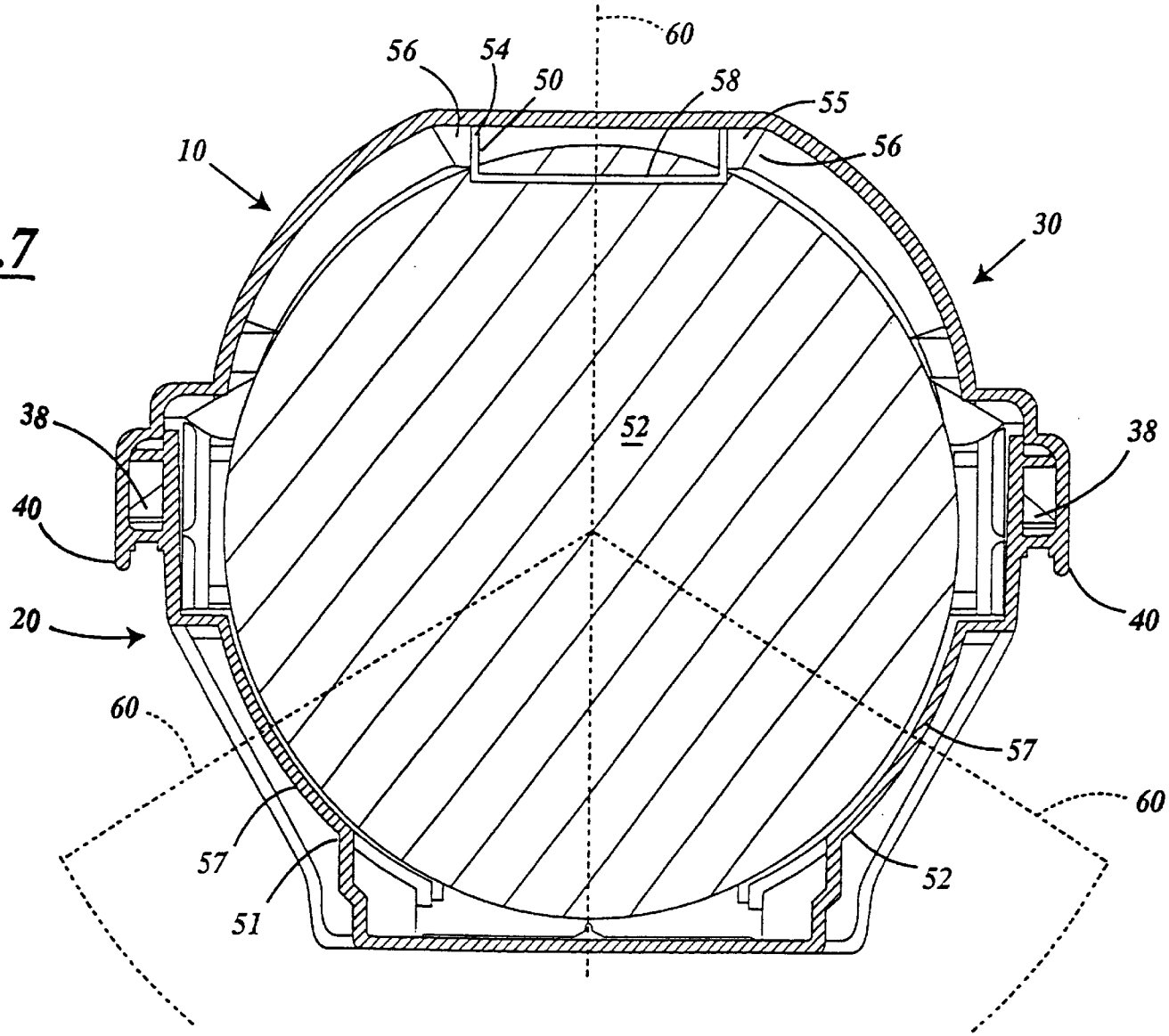
FIG. 7 a cross section through line B—B in FIG. 4.

Of greater significance is the interior construction of the container 10. As shown in FIG. 7, three cushions 50, 51 and 52 are secured to the inside walls of the container 10. Two of the cushions 51 and 52 are attached to the bottom 20 and other cushion 50 is attached to the top 30. With the cover 30 closed, the three cushions are centered about the interior of the container 10 at a 120° angle with respect to each other.

The cushions 50, 51 and 52 are preferably removable from the container 10. This allows cushions of differing designs to be used to hold different types of items. For example, cushions such as those shown in U.S. Pat. No. 5,423,422 can be used in the container 10 to hold flat panel or liquid crystal displays. When the container 10 is used to hold silicon wafers or memory disks, cushions like those disclosed in U.S. Pat. No. 5,273,159 might be used. Both of these patents are owned by Empak, Inc., and are incorporated herein by reference. Other types of cushions could be used for masks or other items to be held. Also, because the cushions 50, 51 and 52 can be removed and replaced, the useful life of the container 10 is extended.

Figure 8:
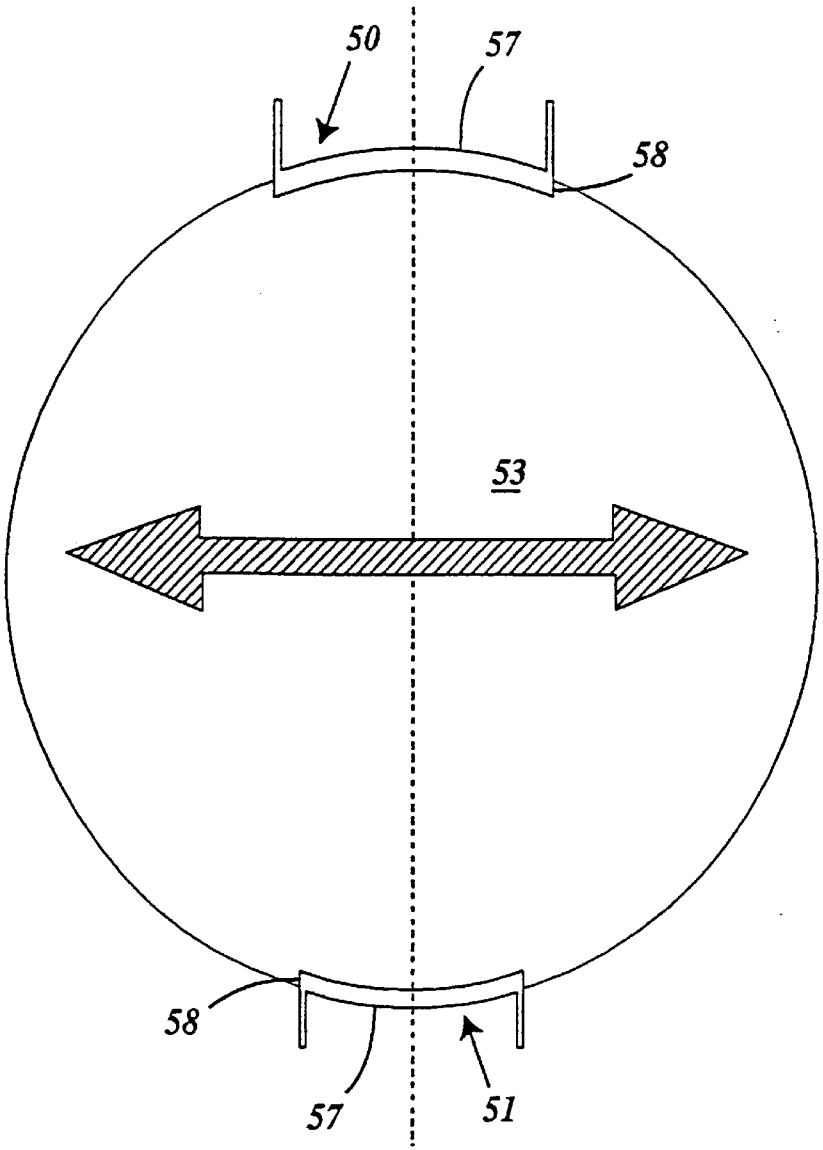
FIG. 8 is a schematic representation of a conventional prior art support technique.

FIG. 8 shows how cushions 50 and 51 of this type were used in pairs in the prior art. When such cushions 50 and 51 are used as shown in FIG. 8, such cushions are capable of adequately supporting smaller, lighter items. However, two cushion configurations are not adequate to fully support larger, heavier objects such as 300 mm diameter silicon wafers.

Figure 9:
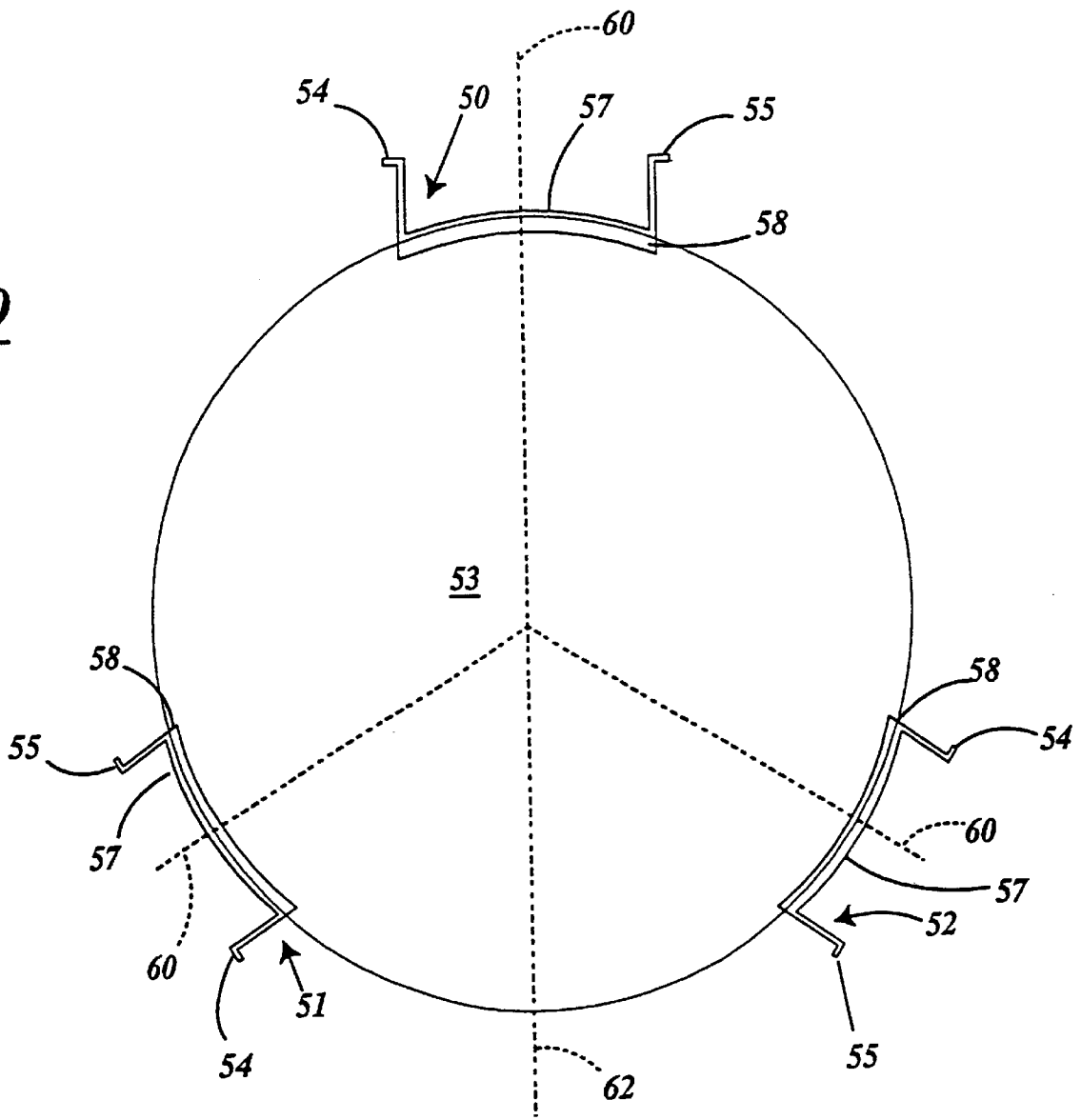
FIG. 9 is a schematic representation of the support technique of the present invention.

The problems inherent in the design shown in FIG. 8 are overcome by adding a third cushion 52 and positioning the three cushions 50, 51 and 52 as shown in FIG. 9. Forces caused by shock or vibration are absorbed by the three cushions 50, 51 and 52 so that items do not become dislodged.

In FIG. 9, wafer cushions 51 and 52 are attached to the bottom 20. Cushions 51 and 52 have center line of support 60 with respect to the wafers 53 about 120° from each other and about 60° from the bottom of the wafers 53. When the top 30 is in place, cushion 50 also engages and supports the wafers 53 so that the center line of support 60 associated with cushion 50, 51 and 52 are separated by approximately 120°.

The precise construction of the cushions 50, 51 and 52 will depend upon the items 53 to be held in the container 10. However, such cushions 50, 51 and 52 will preferably have certain features in common. Such cushions are preferably made of a flexible elastomixic or thermoplastic material. Each cushion will have two parallel rails 54 and 55 designed to engage and be retained by tracks in the container to hold the cushions 50, 51 and 52 in place. Extending between the rails 54 and 55 are a plurality of deformable members 57, each of which is intended to help support one a plurality of items. Each of the deformable members 57 will generally have a pair of dividers forming a channel 58 in which the edge of the item 53 to be supported is received. The channels 58 of the three cushions 50, 51 and 52 are aligned so that cushions 50, 51 and 52 work in conjunction to support a plurality of items 53 in a spaced apart, parallel registration. Most typically, the cushions 50, 51 and 52 will be centered on the respective center lines of support 60. While this is not necessarily the case, it is advantageous to have a portion of each cushion present on either side of its associated center line of support 60.

The principal benefits derived from positioning cushions 50, 51 and 52 as shown in FIGS. 7 and 9 relate to the support provided to the items 53 stored in the container 10. This arrangement makes it possible for the cushions 50, 51 and 52 to securely hold items of a larger size and weight (for example, wafers having a diameter of 300 mm or more) and withstand jarring of the container 10 in any direction. The arrangement shown in FIG. 8 can handle jarring in the up and down directions. However, when a jarring force is applied from the side (as shown by the arrow 100 in FIG. 8) and larger, heavier items 53 are stored in the container, the items 53 can come loose or be damaged. Thus, the arrangement shown in FIGS. 7 and 9 is superior to that shown in FIG. 8.

Those skilled in the art will recognize that bottom 20 and top 30 can be made of a clear material so the contents of the container 10 can be viewed even when the container 10 is closed. Likewise, a bar code, transponder, or microterminal could be affixed to the container 10 for identification, tracking, or communications purposes. Also, a gasket or O-ring can be provided to ensure a tight seal between the top and bottom. Finally, because the cushions 50, 51 and 52 are removable, one skilled in the art, without deviating from the invention, could construct a cassette which, when inserted within the container 10, would serve the same function as one or more of the cushions.

The description provided above in combination with the attached drawings will give those skilled in the art a clear understanding of the present invention, the scope of which is defined by the following claims.

We claim:

1. A container for holding a plurality of items, said container comprising:

a. a bottom having an opening for loading and unloading said items;

b. a removable top for covering the opening of the bottom; and c. three cushions which cooperate with each other to retain each of said plurality of items in a parallel, spaced apart position with respect to each of the other of said items, one of said cushions attached to the top and the other two of said cushions attached to the bottom, each of said cushions supporting said items along a center line of support, the center line of support associated with each cushion being located approximately 120° from the center lines of support associated with each of the other two cushions when the top is covering the opening of the bottom.

2. The container of claim 1 wherein each of said cushions has a pair of rails, a plurality of deformable members, each deformable member having a pair of dividers forming a channel for receiving the edge of an item to be transported in the container.

3. The container of claim 2 wherein the channels and dividers on the three cushions cooperate to hold a plurality of items in a parallel, spaced apart registration.

* * * * *

UNITED STATES PATENT AND TRADEMARK OFFICE

CERTIFICATE OF CORRECTION

PATENT NO. :5,803,269
DATED :September 8, 1998
INVENTOR(S) :Jacoby, et al

It is certified that error appears in the above-identified patent and that said Letters Patent is hereby corrected as shown below:

Column 2,1ine 14, delete "A-A" and inset -- 6-6 --.

Column 2, line 15, delte "B-B" and insert -- 7-7 --.

Signed and Sealed this

Ninth Day of March, 1999

*Attest:*

*Attesting Officer*

Q. TODD DICKINSON

*Acting Commissioner of Patents and Trademarks*